United States Patent [19]

Jahnke et al.

[11] Patent Number: 4,502,869

[45] Date of Patent: Mar. 5, 1985

[54] SYNTHESIS GAS GENERATION PROCESS WITH CONTROL OF RATIO OF STEAM TO DRY GAS

[75] Inventors: Frederick C. Jahnke, Rye; William B. Crouch, Chappaqua, both of N.Y.; George M. Gulko, Houston, Tex.

[73] Assignee: Texaco Inc., White Plains, N.Y.

[21] Appl. No.: 510,488

[22] Filed: Jul. 5, 1983

[51] Int. Cl.[3] ..... C10J 3/46

[52] U.S. Cl. ..... 48/197 R; 48/215; 252/373

[58] Field of Search ..... 48/197 R, 215; 252/373

[56] References Cited

U.S. PATENT DOCUMENTS 4,205,963 6/1980 Marion et al. ..... 48/197 R 4,248,604 2/1981 Woldy et al. ..... 48/197 R 4,411,670 10/1983 Marion et al. ..... 48/197 R

*Primary Examiner*—Peter Kratz

*Attorney, Agent, or Firm*—Robert A. Kulason; Carl G. Seutter

[57] ABSTRACT

Synthesis gas is produced by partial oxidation of hydrocarbon charge, a first portion being cooled by indirect heat exchange and scrubbed before being combined with the quenched second portion en route to particulate scrubbing, the combined gas scrubber overhead being characterized by a desired steam:dry gas ratio which is controlled by regulating the flow of the quenched second portion in accordance with the measured properties of the combined scrubber overhead gas.

11 Claims, 1 Drawing Figure

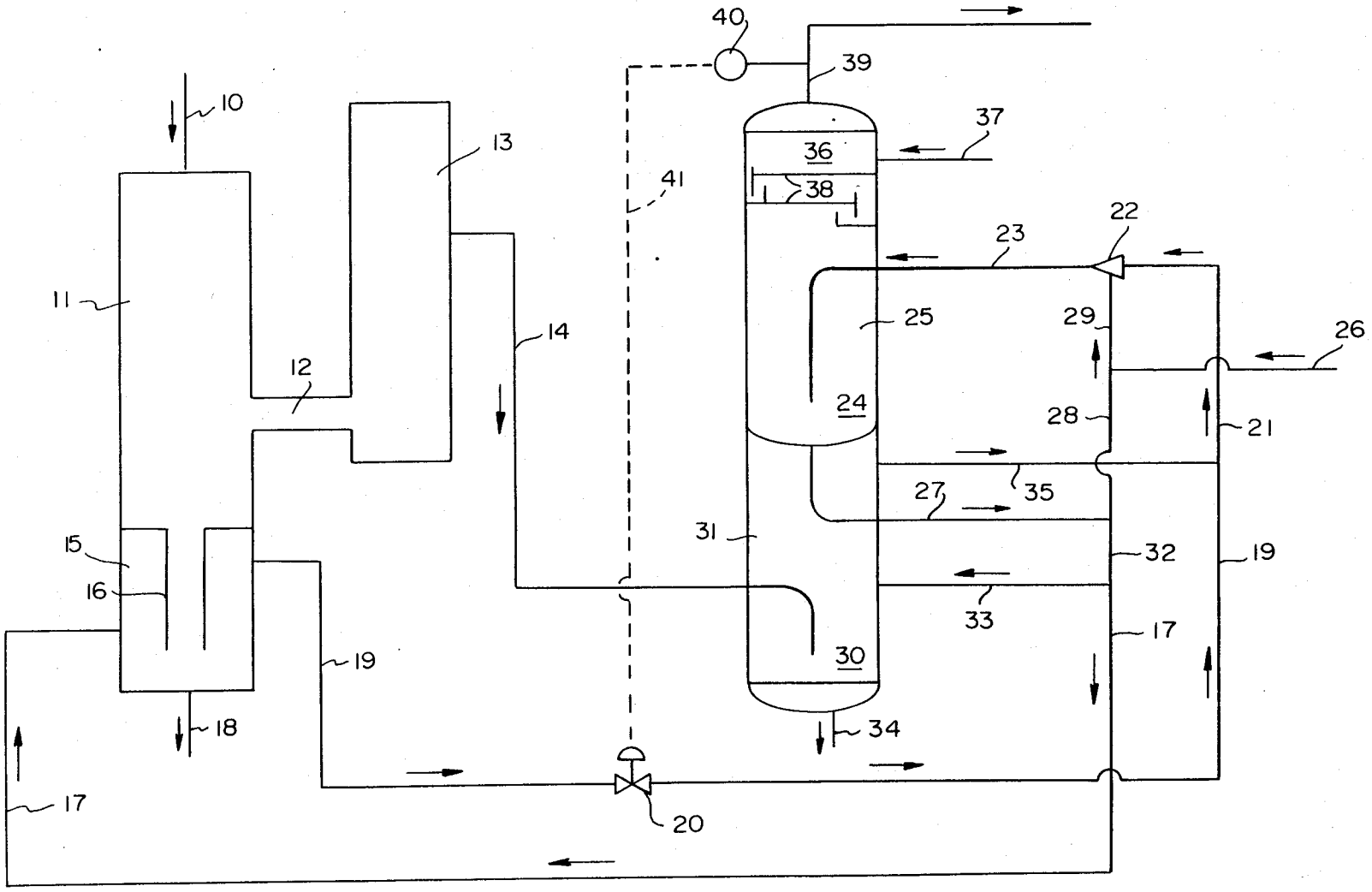
26
21
19
22
29
28
32
17
23
35
37
33
25
27
39
36
38
24
30
34
40
31
41
20
14
13
19
12
10
18
11
15
16
17

SYNTHESIS GAS GENERATION PROCESS WITH CONTROL OF RATIO OF STEAM TO DRY GAS

FIELD OF THE INVENTION

This invention relates to the production of synthesis gas by partial oxidation of hydrocarbon charge.

BACKGROUND OF THE INVENTION

As is well known to those skilled in the art, it is possible to form synthesis gas by partial oxidation of a carbon-containing charge composition in the presence of steam and oxygen-containing gas to yield product containing principally carbon monoxide and hydrogen with lesser quantities of carbon dioxide and steam as well as other components including hydrogen sulfide, carbonyl sulfide, nitrogen, methane, inert gases, etc. It is desired, in many instances, to pass this gas to a water-gas shift reactor wherein carbon monoxide and water react to form carbon dioxide and hydrogen.

In prior practice, utilizing water-gas shift catalysts typified by iron oxide or by cobalt-molybdenum catalysts, it has been found desirable to control the mole ratio of steam to dry gas in the charge to water gas shift reactor at a mole ratio of above 1.4 and typically about 1.4–1.5, say 1.5. However, new catalysts, typified by high activity cobalt-molybdenum catalysts, permit shift section design to be modified, permitting co-production of high pressure export steam, thus improving overall energy utilization. These new catalysts require less steam than do the prior art catalysts; and typically these new catalysts require that the predetermined mole ratio be 0.8–1.3, preferably 1.0–1.1, say about 1.0. It has not been found to be possible to readily attain this mole ratio with prior art synthesis gas configurations.

It is an object of this invention to provide a novel process for synthesis gas production. Other objects will be apparent to those skilled in the art.

STATEMENT OF THE INVENTION

In accordance with certain of its aspects, this invention is directed to a method of partially oxidizing a carbon-containing charge fuel in the presence of temperature moderator and an oxygen-containing gas thereby forming a hot synthesis gas containing carbon monoxide and hydrogen;

cooling a first portion of said hot synthesis gas by indirect heat exchange thereby forming a partially cooled first portion of said hot synthesis gas;

contacting a second portion of said hot synthesis gas with a body of aqueous liquor in a quench operation thereby forming a partially cooled second portion of said hot synthesis gas;

scrubbing said partially cooled first portion of said hot synthesis gas with aqueous scrubbing liquor in a first scrubbing operation thereby forming a further cooled first portion of said hot synthesis gas;

scrubbing said further cooled first portion of said hot synthesis gas and said partially cooled second portion of said synthesis gas in a second scrubbing operation in contact with aqueous liquor thereby forming a combined final product synthesis gas having a predetermined mole ratio of steam to dry gas;

withdrawing said final product synthesis gas having a predetermined mole ratio of steam to dry gas as a final product stream; and controlling the flow of said partially cooled second portion of said hot synthesis gas to said second scrubbing operation in accordance with the temperature or flow of said combined final product synthesis gas stream exiting said second scrubbing operation thereby maintaining the predetermined mole ratio of steam to dry gas in said final product synthesis gas.

DESCRIPTION OF THE INVENTION

The charge carbon-containing fuel which may be employed in the process of this invention may include a fossil fuel such as a solid coal, a liquid hydrocarbon, or a gaseous fuel such as natural gas.

The charge to the process of this invention includes carbonaceous fuels which are solid at ambient temperature and which contain ash. Typical of such fuels are coals including anthracite, bituminous, sub-bituminous, lignite, coke from coal, petroleum coke, particulate carbon, tar sand, asphalt, pitch, residue from coal liquefaction, etc. Typically, these fuels may contain ash in amounts as little as 0.1 w %–0.5 w % or as much as 20 w %–40 w %. They may also contain water in amounts as low as 0 w %–10 w % or as much as 30 w %–40 w % or more. Although the charge fuel may be used without reducing the moisture content, it is preferred, to facilitate grinding and slurrying in the case of those fuels containing large amounts of water, to pre-dry the fuel to a moisture content to 2 w %–20 w % depending on the nature of the fuel.

The charge fuel may be ground to a particle size so that preferably 100 w % passes through a 14 mesh sieve and greater than 50 w % has a particle size within the range of 14–325 mesh sieve. In the case of some pitches, asphalts, and tar sand, it may be possible to feed them as liquids by heating them to just below their decomposition temperature. The ground solid fuel may be employed as charge; but preferably it is slurried in a liquid vaporizable hydrocarbon or water, or it is entrained in a gaseous medium.

The preferred slurrying agent is water; and it is preferably present in the charge to gasification in amount of 30–120 parts per 100 parts of solid coal or coke.

Alternatively, the ground solid fuel may be entrained in a gas such as steam, carbon dioxide, nitrogen, recycle synthesis gas, air, etc.

Typical liquid hydrocarbons which may be employed include various oils derived from petroleum including distillates and residues such as crude petroleum, reduced crude, gas oil, cycle gas oil, coker gas oil, furfural extract of coker gas oil, etc; oil derived from coal, tar sands, lignite; etc. Such liquids may be employed in the form of a slurry which includes 100 parts of solid coal or coke with 40–150 parts, preferably 50–100 parts, say 55–60 parts of liquid.

The charge carbonaceous fuel may be a hydrocarbon gas typified by narrow boiling-range refinery off-gas streams, lower alkanes, natural gas, etc.

In the preferred embodiment, the charge fuel may be a hydrocarbon liquid including gas oils, etc. or more preferably heavier stocks including short resid (bottoms from vaccum distillation), pitch, an asphalt from a solvent deasphalting operation, etc.

A typical pitch which may be charged as a liquid or a solid may have the following properties:

TABLE

| Property | Value |
|---|---|
| Composition w % | |
| C | 85.94 |

TABLE-continued

| Property | Value |
|---|---|
| H | 9.49 |
| S | 2.40 |
| N | 1.40 |
| O | 0.47 |
| Ash | 0.01–0.5 |
| °API | −14.6 |
| Viscosity Cst @ 150° C. | 1,000 |
| Viscosity Cst @ 250° C. | 30 |

A typical short resid may have the following properties:

TABLE

| Property | Value |
|---|---|
| Composition w % | |
| C | 84.65 |
| H | 9.96 |
| S | 4.50 |
| N | 0.39 |
| O | 0.40 |
| Ash | 0.10 |
| °API | 12.8 |
| Viscosity Cst ° 50° C. | 1000 |

If desired, there can also be charged a supplemental temperature moderator to moderate the temperature in the reaction zone. Moderators may be necessary when the charge includes liquid vaporizable hydrocarbons in order to simultaneously achieve desired conversion level (optimum efficiency) and temperature (fixed by materials of construction). When employed, they may be admitted with any of the charge streams or separately. Typical temperature moderators may include superheated steam, saturated steam, carbon dioxide-rich gas, cooled exhaust from downstream turbines, nitrogen-in-air, by-product nitrogen from a conventional air separation unit, etc.

Charge also includes a free-oxygen-containing gas. Typical of such gases which contain at least about 21 w % oxygen include air, oxygen-enriched air (containing more than 21 w % oxygen), substantially pure (e.g. greater than 95 w %) oxygen, etc. Commonly, this gas contains oxygen plus other gases derived from the air from which the oxygen was prepared.

Total charge commonly contains the following parts by weight:

TABLE

| Component | Parts | | |
|---|---|---|---|
| | Broad | Preferred | Typical |
| Fuel | — | — | 100 |
| Slurrying Liquid | 0–150 | 30–120 | 60 |
| Oxygen-containing Gas, atoms of free oxygen per atom of carbon | 0.7–1.6 | 0.8–1.4 | 0.95 |
| Moderator | 0–200 | 30–100 | 50 |
| Total Water | 40–150 | 40–100 | 75 |

When the charge fuel is a liquid or a gas, no slurrying liquid is admitted with the charge.

The atomic ratio of oxygen (in the free-oxygen-containing gas) to carbon (in the fuel) may be 0.7–1.6. When the oxygen-containing gas is substantially pure oxygen, the ratio may be 0.7–1.5, preferably 0.9. When it is air, the ratio may be 0.8–1.6, say 1.3. When water is the temperature moderator as in the case when liquid hydrocarbon is used as slurrying medium, the weight ratio of water to carbon in the fuel may be 0–2.0, preferably 0.2–0.6, say 0.5.

In typical operation according to one embodiment, the total charge might contain 100 parts of ground anthracite, 60 parts of water as slurrying fluid, no temperature moderator, and sufficient air to attain an atom ratio of 1.3 free oxygen to carbon in the fuel. In another embodiment, in the total charge may contain 100 parts of ground bituminous, 100 parts of light cycle gas oil, 160 parts of superheated steam and sufficient enriched air containing 80 w % oxygen to attain a ratio of 1.0 free oxygen atoms per atom of carbon in the fuel.

In a more preferred embodiment utilizing a liquid hydrocarbon charge, the total charge might contain 100 parts SDA pitch from a solvent deasphalting operation, no slurrying fluid, 40 parts of superheated steam as temperature moderator, and sufficient oxygen (99 w % purity) to attain a ratio of 0.95 free oxygen atoms per atom of carbon in the fuel.

In practice of the process of this invention, the carbon-containing charge is heated to 25° C.–300° C., say 250° C. prior to admission to gasification; and the free-oxygen-containing gas may be heated to 25° C.–500° C., say 80° C. When employed, the supplemental temperature moderator may be heated to 25° C.–300° C., say 270° C.

The charge materials, including free-oxygen-containing gas and moderator are admitted to a partial oxidation synthesis gas generation, typified by that set forth in U.S. Pat. No. 2,818,326 to Texaco as assignee of Eastman et al. This generator includes an annulus-type burner (such as is typified by that set forth in U.S. Pat. Nos. 2,928,460 or 4,328,006 or 4,328,008) in a vertical cylindrical steel pressure vessel lined with a thermal refractory material.

As the charge components are admitted to the reaction vessel-combustion chamber, incomplete combustion is effected to yield a product hot raw gas which principally contains hydrogen, carbon monoxide, steam and carbon dioxide. Other materials which may typically be present may include hydrogen sulfide, carbonyl sulfide (COS), methane, ammonia, nitrogen, and inert gases typified by argon.

The principal gaseous components, in the product may include the following (volume % on a dry basis) when substantially pure oxygen is fed to the combustion chamber:

TABLE

| Component | Broad | Typical |
|---|---|---|
| Carbon Monoxide | 30–60 | 51 |
| Hydrogen | 5–40 | 43 |
| Carbon Dioxide | 5–35 | 5 |
| Hydrogen Sulfide + COS | 0–5 | 0.6 |
| Nitrogen | 0–5 | 0.2 |
| Methane | 0–2 | 0.3 |
| Inert Gases | 0–1.5 | 0.3 |

When air replaces the pure oxygen, the composition may be as follows (volume % dry basis):

TABLE

| Component | Broad | Typical |
|---|---|---|
| Carbon Monoxide | 10–35 | 18 |
| Hydrogen | 2–20 | 12 |
| Carbon Dioxide | 5–25 | 7 |
| Hydrogen Sulfide + COS | 0–3 | 0.5 |
| Nitrogen | 45–70 | 62 |
| Methane | 0–2 | 0.1 |

TABLE-continued

| Component | Broad | Typical |
|---|---|---|
| Inert Gases | 0.1–1.5 | 0.8 |

The autogenous temperature in the combustion chamber of the gas generation zone may be 1100° C.–1600° C., say 1400° C. at 100–1500 psig, preferably 500–1200 psig, say 900 psig. Residence time for gasification may be 1–10 seconds, preferably 1–7 seconds, say about 2–5 seconds.

When the charge includes a solid, such as a coal, the product synthesis gas contains a particulate ash phase containing up to about 20 w % of the organic carbon in the feed and typically about 1 w %–8 w %, say 4 w %.

The hot raw product synthesis gas leaves typically through a centrally positioned outlet in the bottom of the reaction zone, the outlet being coaxial with the central longitudinal axis of the reaction zone-gas generator. The gas stream is split and a portion passes downwardly through a bottom outlet zone and then is admitted to the upper portion of a radiant cooler. The temperature of the gas as it is admitted to the radiant cooler is 1100° C.–1600° C., say 1400° C. The linear velocity of the gas decreases as it enters the radiant cooling operation which is preferably located directly below and is coaxial with the central vertical axis of the reaction zone of the gas generator.

The radiant cooling chamber includes a lining and a means for removing radiant heat impinging on the liner. This preferably includes a heat exchange surface made up of a series of connected tubes arrayed preferably parallel to the main axis of the chamber. Heat exchange fluid passes through these tubes.

During passage of the synthesis gas through the radiant cooling chamber, it is cooled by radiation typically to 1000° C.–1200° C., say 1100° C. Ash contained therein is projected by velocity and gravity heads in a downward direction to permit it to pass along the axis of the cooling chamber toward the outlet. The tubes of the radiant cooling chamber may undesirably collect ash depositing thereon; and to minimize this, there may be provided a plurality of soot-blowing nozzles spaced adjacent to the tubes by means of which steam or inert gas may be directed onto the tubes to thereby remove ash and soot which deposits thereon.

The ash is preferably directed downwardly through and out of the radiant cooling chamber into an ash collection zone wherein the ash is cooled and collected.

When the carbon-containing charge is a gas or liquid (generally characterized by a lower ash content than is found in the case of solid charge), the combustion chamber may not contain a radiant cooling chamber; and cooling is effected as hereinafter set forth.

In practice of the process of this invention, a first portion of the hot synthesis gas is withdrawn from the combustion chamber at 1100° C.–1600° C., say 1350° C. and 50–1500 psig, say 900 psig. This first portion may be 15–35 v %, say about 25 v % of the total synthesis gas generated in the combustion chamber.

The first portion of the hot synthesis gas may be passed to a waste heat boiler wherein it is passed in indirect heat exchange against water as it is cooled to 280° C.–400° C., say 350° C. at 30–1450 psig, say 850 psig.

The so-cooled first portion of the gas may then be passed through a first particulate scrubbing operation wherein by contact with aqueous scrubbing liquid, it is further cooled to 150° C.–250° C., say 200° C. at 30–1450 psig, say 850 psig.

The second portion of the cooled synthesis gas (preferably containing 65–85 v %, say 75 v % of the total synthesis gas generated in the combustion chamber) which leaves the bottom portion of the combustion chamber chamber at 1100° C.–1600° C., say 1350° C. is preferably passed downwardly through a constricted channel below the lower portion of the combustion chamber. It is then passed into a quenching operation wherein it is contacted with a body of aqueous liquid. In the preferred embodiment it is bubbled through the body of aqueous liquid in the quench chamber. This serves to remove a portion of the solid particulate from the gas and to cool this gas to about 150° C.–300° C., say 250° C.

It is desirable to provide for continuous or periodic removal of particulates from the quench operation.

In practice of the process of this invention, the second portion of the cooled synthesis gas which leaves the quench chamber as a partially cooled second portion of synthesis gas (at 150° C.–300° C., say 250° C. and 25–1455 psig, say 895 psig) is passed to a second scrubbing operation wherein it is contacted with aqueous liquor. There is also admitted to the second scrubbing operation (at 150° C.–250° C., say 200° C. and 30–1450 psig, say 850 psig) the scrubbed first portion of the synthesis gas exiting the first scrubbing operation. In the preferred embodiment, these streams may be combined (prior to admission to the second scrubbing operation) to form a combined stream at 150° C.–300° C., say 230° C. and 25–1445 psig, say 845 psig.

There is also admitted to the second scrubbing operation, 15–150 parts, say 55 parts of fresh scrubbing aqueous liquor at 100° C.–300° C., say 250° C. and 5–50 parts, say 18 parts of recycle aqueous liquor (per 100 parts wet gas by weight) at 150° C.–300° C., say 250° C. Preferably the aqueous scrubbing liquor is admixed with the mixed charge gas stream to the second scrubbing operation prior to admission thereto; mixing may be effected as by passing the gas stream through an eductor to which the liquid stream is admitted.

In the second scrubbing operation, the synthesis gas admitted thereto is contacted with a pool of aqueous liquor derived from the aqueous liquor admitted therewith. During scrubbing, the gas is cooled to 150° C.–300° C., say 230° C. at 15–1430 psig, say 830 psig.

The aqueous liquor from the second scrubbing operation is withdrawn as from a lower portion thereof; a portion (0–75 v %, say 25 v %) may be recycled to the second scrubbing operation and the remainder passed as aqueous liquor at 150° C.–300° C., say 250° C. to the first scrubbing operation and to the quench operation. The aqueous liquor may be withdrawn from the latter two operations and withdrawn from the system.

The combined gas in the second scrubbing operation, after contact with the pool of aqueous liquor is preferably passed upwardly through a countercurrent contact zone which may include a plurality of trays over which aqueous liquor is passing and descending downwardly into the lower portion of the second scrubbing operation. The aqueous liquor admitted to this countercurrent contact zone is preferably a stream different from that admitted to the lower portion of the second scrubbing zone. In a preferred embodiment (per 100 parts of synthesis gas at 150° C.–300° C., say 230° C. and 15–1430 psig, say 830 psig admitted to the second scrubbing zone), there may be admitted 5–100 parts, say 25 parts of liquor at 100° C.–300° C., say 200° C. and 15–1430 psig, say 830 psig with the gas.

Combined final product synthesis gas leaving the top of the countercurrent contact zone at 100° C.–300° C., say 225° C. and 10–1425 psig, say 825 psig is characterized by a predetermined steam to dry gas mole ratio of 0.8–1.3:1, say 1.0:1.

It is a feature of the process of this invention that this predetermined ratio of steam to dry gas may be maintained by controlling the split of the two streams of gas leaving the synthesis gas generation operation. Specifically the amount of gas in the second portion of the synthesis gas leaving the quenching operation (i.e. the partially cooled second portion of the synthesis gas) is controlled in accordance with the characteristics of the product synthesis gas leaving the overhead from the countercurrent contacting operation.

This is effected by measuring a desired property (e.g. the flow rate or preferably the temperature) of the gas and controlling the flow of the partially cooled second portion of the hot synthesis gas to the second scrubbing operation in accordance with that property of the final product synthesis gas exiting the second scrubbing operation. By measuring the flow (i.e. the temperature, the actual flow rate, the actual ratio of steam to dry gas, etc) it is possible to effect the desired control.

In typical operation, the product synthesis gas leaving the second scrubbing operation containing carbon monoxide, hydrogen, steam, and carbon dioxide and lesser quantities of methane, argon, nitrogen, hydrogen sulfide, and carbonyl sulfide may be characterized by a mole ratio of steam to dry gas of 1.00 at a temperature of 442° F., a pressure of 860 psig, and flow rate of 4550 pound moles per hour.

This is effected by passing 25 v % of the synthesis gas formed in the combustion chamber through indirect heat exchange, first scrubbing operation and thence to second scrubbing operation, and 75 v % of that synthesis gas through the quench operation and thence directly to the second scrubbing operation.

If, due to external factors, the flow at the outlet of the second scrubbing operation dropped to say 4400 pound moles per hour with all other independent factors remaining constant, it would be found that the ratio of steam to dry gas at this point would undesirably be 0.93:1. As the change in flow is measured, a control signal is generated which opens the valve in the line carrying the partially cooled second portion of synthesis gas exiting the quench chamber and passing to the second scrubbing operation thereby increasing the flow of gas therein so that it corresponds to 75 v % of the synthesis gas formed in the combustion chamber.

In an alternative embodiment, the measurable property of the stream may be the temperature. If it be found for example that the temperature has dropped from the desired level of 442° F. to say 432° F., it would be found that the ratio would be 0.82:1. As the change in temperature is measured by the temperature control mechanism, a control signal is generated which opens the valve in the line carrying the partially cooled second portion of synthesis gas exiting the quench chamber and passing to the second scrubbing operation, thereby increasing the flow of gas therein so that it corresponds to 75 v % of the synthesis gas formed in the combustion chamber which in turn returns the steam to dry gas ratio to the desired value.

In similar manner, the control signal may be generated in accordance with other properties or characteristics of the stream including the actually measured ratio of steam to dry gas, etc. each measured by use of standard measuring instruments.

In this manner, it is thus possible to control the desired ratio of steam to dry gas so that it may be at the proper level for use as feed to a syngas shift operation wherein carbon monoxide is reacted with water to produce carbon dioxide and hydrogen.

Practice of the process of this invention will be apparent to those skilled in the art from the attached drawing and the following description of the best mode presently known of carrying out the process of this invention.

DESCRIPTION OF THE DRAWING

The attached drawing is a schematic process flow diagram of the best mode presently known of practicing the process of this invention.

DESCRIPTION OF THE PREFERRED EMBODIMENT

In practice of the process of this invention according to the best mode presently known, there is charged through line 10, the "typical pitch" set forth supra in amount of 100 parts at 260° C. Also admitted through line 10 are 109 parts of 99.6 v % oxygen and 41 parts of steam at 290° C. and 1000 psig. The atomic ratio of carbon to oxygen in the charge is 1.08:1.

In gasification vessel 11 (fitted with a thermally resistant lining which defines a combustion chamber), incomplete combustion is effected to yield a product hot raw synthesis gas containing the following parts by volume (dry basis):

TABLE

| COMPONENT | VOL % |
|---|---|
| Carbon Monoxide | 51 |
| Hydrogen | 43 |
| Carbon Dioxide | 5 |
| Hydrogen Sulfide + COS | 0.6 |
| Nitrogen | 0.2 |
| Methane | 0.3 |
| Argon | 0.3 |

The combustion chamber 11 has an average temperature of 1350° C. at 900 psig. A first portion (containing 25 v % of the synthesis gas produced in chamber 11) is withdrawn through line 12 to indirect heat exchanger 13—a waste heat boiler. Here the gas is cooled by indirect heat exchange against boiler feed water to 340° C. at 870 psig. The partially cooled first portion of the hot synthesis gas is withdrawn from indirect heat exchanger 13 through line 14.

A second portion of the synthesis gas, containing 75 v % of the synthesis gas generated in combustion chamber 11 is passed at 1350° C. and 900 psig to quench chamber 15 wherein it is passed downwardly through conduit 16 into contact with a body of aqueous liquid admitted through line 17. Liquid may be drawn off as desired through line 18.

The second portion of synthesis gas leaving quench chamber 15 through line 19 at 240° C. and 895 psig is passed through control valve 20 in line 19 and thence through line 21 to eductor 22 and line 23 to the lower portion 24 of second scrubbing operation 25.

There is also admitted to scrubbing operation 25 fresh aqueous liquid at 200° C. through line 26 and recycle aqueous liquor at 225° C. withdrawn from the lower portion 24 of second scrubbing operation 25 through line 27 and passed through lines 28 and 29.

In this embodiment, the partially cooled first portion of the synthesis gas in line 14, at 340° C. and 870 psig, is passed to the lower portion 30 of first scrubbing operation 31 wherein it is scrubbed with aqueous scrubbing liquid from lines 27, 32, and 33. Liquid may be drawn off through line 34.

The further cooled first portion of the synthesis gas at 200° C. and 865 psig is withdrawn through line 35 from which it is passed to line 21.

The liquid stream of aqueous scrubbing liquid in line 29 is preferably passed to second scrubbing operation 25 through venturi contactor 22 to which synthesis gas from line 21 is admitted. Additional scrubbing is effected in the lower portion 24 of second scrubbing operation 25.

In the preferred embodiment, the scrubbed gas leaving lower portion 24 is passed upwardly to upper portion 36 wherein the gas is further scrubbed by scrubbing liquor (preferably condensate from the water gas shift operation) entering through line 37 and passing across liquid-vapor contact trays 38. The synthesis gas stream leaving through line 39 at 228° C. and 834 psig is characterized by a mole ratio of steam to dry synthesis gas of 1.0:1 and by a composition (dry basis) as follows:

TABLE

| COMPONENT | VOL % |
|---|---|
| Carbon Monoxide | 51 |
| Hydrogen | 43 |
| Carbon Dioxide | 5 |
| Hydrogen Sulfide + COS | 0.1 |
| Nitrogen | 0.1 |
| Methane | 0.3 |
| Argon | 0.2 |

Control of this steam to dry gas mole ratio is effected in this embodiment by a temperature control element 40 which measures the temperature of the stream in line 39. When the temperature in line 39 increases, e.g. to 229° C., (i.e. 1° C. more than the desired 228° C.), a signal is generated, schematically shown as passing through control line 41, which activates valve 20 whereby the valve is closed to thereby lessen the flow therein so that the quantity of gas flowing through line 19 is decreased and the new quantity is 75 v % of the total generated in operation 11. Similarly, if the measuring element 40 indicates that the temperature has decreased, the signal which is generated, activates valve 20 so that the quantity of gas passing therethrough is increased. In this manner, the temperature (and thus the mole ratio of steam to dry gas) is maintained at the desired level.

In an alternate less preferred embodiment, the control valve 20 may be activated by a change in the rate of flow of the stream in line 39.

It is a feature of the process of this invention that it may be characterized by the following advantages:

(i) it permits operation in a manner to maintain the desired mole ratio of steam to dry gas at predetermined level;

(ii) it accomplishes this objective in a simple manner utilizing a minimum of controls;

(iii) it permits use of desired variables (temperature, rate of flow, composition of gas, etc.) to effect the stated result;

(iv) it requires minimum capital and operating cost;

(v) it permits operation with one scrubbing vessel for two gas streams;

(vi) it permits operation by measurement of a clean stream rather than by measurement of the soot-containing streams leaving the quench operation or the indirect heat exchanger; etc.

Although this invention has been illustrated by reference to specific embodiments, it will be apparent to those skilled in the art that various changes and modification may be made which clearly fall within the scope of this invention.

We claim:

1. The method which comprises partially oxidizing a carbon-containing charge fuel in the presence of temperature moderator and an oxygen-containing gas thereby forming a hot synthesis gas containing carbon monoxide and hydrogen;

cooling a first portion of said hot synthesis gas by indirect heat exchange thereby forming a partially cooled first portion of said hot synthesis gas;

contacting a second portion of said hot synthesis gas, with a body of aqueous liquid in a quench operation thereby forming a partially cooled second portion of said hot synthesis gas;

scrubbing said partially cooled first portion of said hot synthesis gas with aqueous scrubbing liquor in a first scrubbing operation thereby forming a further cooled first portion of said hot synthesis gas;

scrubbing said further cooled first portion of said hot synthesis gas and said partially cooled second portion of said synthesis gas in a second scrubbing operation in contact with aqueous liquor thereby forming a final product synthesis gas having a predetermined mole ratio of steam to dry gas;

withdrawing said final product synthesis gas having a predetermined mole ratio of steam to dry gas as a final product stream; and controlling the flow of said partially cooled second portion of said hot synthesis gas to said second scrubbing operation in accordance with the temperature or flow of said final product synthesis gas exiting said second scrubbing operation thereby maintaining the predetermined mole ratio of steam to dry gas in said final product synthesis gas.

2. The method claimed in claim 1 wherein said carbon-containing charge fuel is a solid carbonaceous fuel.

3. The method claimed in claim 1 wherein said first portion of said hot synthesis gas contains 15 v %–50 v % of the total of said hot synthesis gas.

4. The method claimed in claim 1 wherein said first portion of said hot synthesis gas is cooled by indirect heat exchange to 280° C.–400° C.

5. The method claimed in claim 1 wherein said second portion of said hot synthesis gas, containing 50 v %–85 v % of the total of said hot synthesis gas, is cooled to 200° C.–280° C. in said quench operation.

6. The method claimed in claim 1 wherein said further cooled first portion of said hot synthesis gas is at temperature of 150° C.–300° C.

7. The method claimed in claim 1 wherein said final product synthesis gas is at temperature of 170° C.–240° C.

8. The method claimed in claim 1 wherein said final product synthesis gas has a predetermined mole ratio of steam to dry gas of 0.8–1.3:1.

9. The method claimed in claim 1 wherein said final product synthesis gas has a predetermined mole ratio of steam to dry gas of 1.0–1.1:1.

10. The method claimed in claim 1 wherein said final product synthesis gas has a predetermined mole ratio of steam to dry gas of about 1:1.

11. The method which comprises partially oxidizing a carbon-containing charge fuel in the presence of temperature moderator and an oxygen-containing gas thereby forming a hot synthesis gas containing carbon monoxide and hydrogen at 1100° C.–1600° C;

cooling a first portion of said hot synthesis gas, containing 15 v %–50 v % of the total, by indirect heat exchange to 280° C.–400° C. thereby forming a partially cooled first portion of said hot synthesis gas;

contacting a second portion of said hot synthesis gas, containing 50 v %–85 v % of the total, with a body of aqueous liquid in a quench operation thereby forming a partially cooled second portion of said hot synthesis gas at 200° C.–280° C.;

scrubbing said partially cooled first portion of said hot synthesis gas with aqueous scrubbing liquid in a first scrubbing operation thereby forming a further cooled first portion of said hot synthesis gas at 150° C.–300° C;

scrubbing said further cooled first portion of said hot synthesis gas and said partially cooled second portion of said synthesis gas in a second scrubbing operation in contact with aqueous liquor thereby forming a final product synthesis gas at 170° C.–270° C. having a predetermined mole ratio of steam to dry gas of 1.0:1;

withdrawing said final product synthesis gas at 170° C.–270° C. having a mole ratio of steam to dry gas of 1.0:1 as a final product stream; and controlling the flow of said partially cooled second portion of said hot synthesis gas to said second scrubbing operation in accordance with the temperature or flow of said final product synthesis gas exiting said second scrubbing operation thereby maintaining the mole ratio of steam to dry gas in said final product synthesis gas at 1.0:1.

* * * * *